US008365327B2

(12) United States Patent
Jamshidi

(10) Patent No.: US 8,365,327 B2
(45) Date of Patent: Feb. 5, 2013

(54) SUPPORT PILLOW FOR PREGNANT WOMAN

(76) Inventor: Anita Jamshidi, Great Falls, VA (US)

( * ) Notice: Subject to any disclaimer, the term of this patent is extended or adjusted under 35 U.S.C. 154(b) by 42 days.

(21) Appl. No.: 12/676,788

(22) PCT Filed: Sep. 5, 2008

(86) PCT No.: PCT/US2008/075460

§ 371 (c)(1),
(2), (4) Date: Jul. 2, 2010

(87) PCT Pub. No.: WO2009/033068

PCT Pub. Date: Mar. 12, 2009

(65) Prior Publication Data

US 2010/0263127 A1 Oct. 21, 2010

Related U.S. Application Data

(60) Provisional application No. 60/970,443, filed on Sep. 6, 2007.

(51) Int. Cl.
*A47C 20/00* (2006.01)

(52) U.S. Cl. ..... 5/631; 5/632; 5/930; 5/652

(58) Field of Classification Search ..... 5/631, 930, 5/948, 632, 640, 652
See application file for complete search history.

(56) References Cited

U.S. PATENT DOCUMENTS

| | | | | |
|---|---|---|---|---|
| 2,563,725 | A | 7/1951 | Leto et al. | |
| 4,397,052 | A | 8/1983 | Lund, III | |
| 4,506,396 | A * | 3/1985 | Ritchie et al. | 5/631 |
| 5,086,529 | A | 2/1992 | DeGroot | |
| 5,182,828 | A * | 2/1993 | Alivizatos | 5/631 |
| 5,272,780 | A | 12/1993 | Clute | |
| 6,795,990 | B1 | 9/2004 | Hutchinson D. C. | |
| 6,886,201 | B1 * | 5/2005 | Weiss-Lohrei | 5/631 |
| 7,017,213 | B2 | 3/2006 | Chisari | |
| 2009/0313760 | A1 * | 12/2009 | Blake et al. | 5/631 |

FOREIGN PATENT DOCUMENTS

GB 2274246 A * 7/1994

OTHER PUBLICATIONS

Lee W. Young (Authorized Officer), PCT International Search Report and Written Opinion of the International Searching Authority, Dec. 3, 2008, PCT Application No. PCT/US2008/075460, PCT ISA/US.
European Search Report dated Nov. 9, 2010.

* cited by examiner

*Primary Examiner* — Robert G Santos
*Assistant Examiner* — Brittany Wilson
(74) *Attorney, Agent, or Firm* — Dicke, Billig & Czaja, PLLC

(57) ABSTRACT

An improved support for use by a pregnant woman to achieve greater comfort while resting or sleeping on her side. The support comprises two pillows connected together by a piece of stretchable fabric. The pillows are shaped to provide greater comfort to the woman, especially over long periods of time, compared to prior designs that employ rounded pillows. Different types of foam are used for the two pillows to tailor the degree of support for the part of the woman's body that is being supported by each pillow. The stretchable fabric enables the support to adapt to the growth of the woman during pregnancy (particularly late term pregnancy). The support may be assembled into a compact, attractive unit for storage.

11 Claims, 5 Drawing Sheets

SUPPORT PILLOW FOR PREGNANT WOMAN

RELATED APPLICATIONS

This application is a National Stage entry of PCT/US2008/075460, filed on Sep. 5, 2008, which claims priority to U.S. Provisional Patent Application No. 60/970,443, filed on Sep. 6, 2007.

BACKGROUND

U.S. Pat. No. 2,562,725 describes a cushioned support placed adjacent to and/or underneath a pregnant woman. This helps her maintain a comfortable position.

SUMMARY

It has been found that designs such as that of U.S. Pat. No. 2,562,725 do not adequately address the important medical and other issues faced by pregnant women. In particular, that design treats the two cushioned sides of the support as identical, and therefore it does not distinguish between a woman lying on her left side as opposed to her right side.

This application discloses an improved cushioned support for placement adjacent a pregnant woman while she is lying on her side. The support comprises two pieces each generally shaped like a "wedge," that is, triangular in cross-section with flat faces and straight edges. Also, one of the pieces is substantially firm (compared to the other piece) to support the woman's back. The other piece is a substantially less firm, "memory" foam that supports and conforms to the shape of the woman's stomach. The two sides are joined together by a flexible, stretchable material that lies beneath the woman's side—preferably her left side, as sleeping on the left side provides optimal blood circulation during pregnancy.

BRIEF DESCRIPTION OF THE DRAWINGS

The figures illustrate a preferred embodiment and thus it should be understood that minor changes in shape, proportion, size, and the like are not critical to the scope of the disclosure except as specifically noted elsewhere in this application.

DETAILED DESCRIPTION

Figure 1:
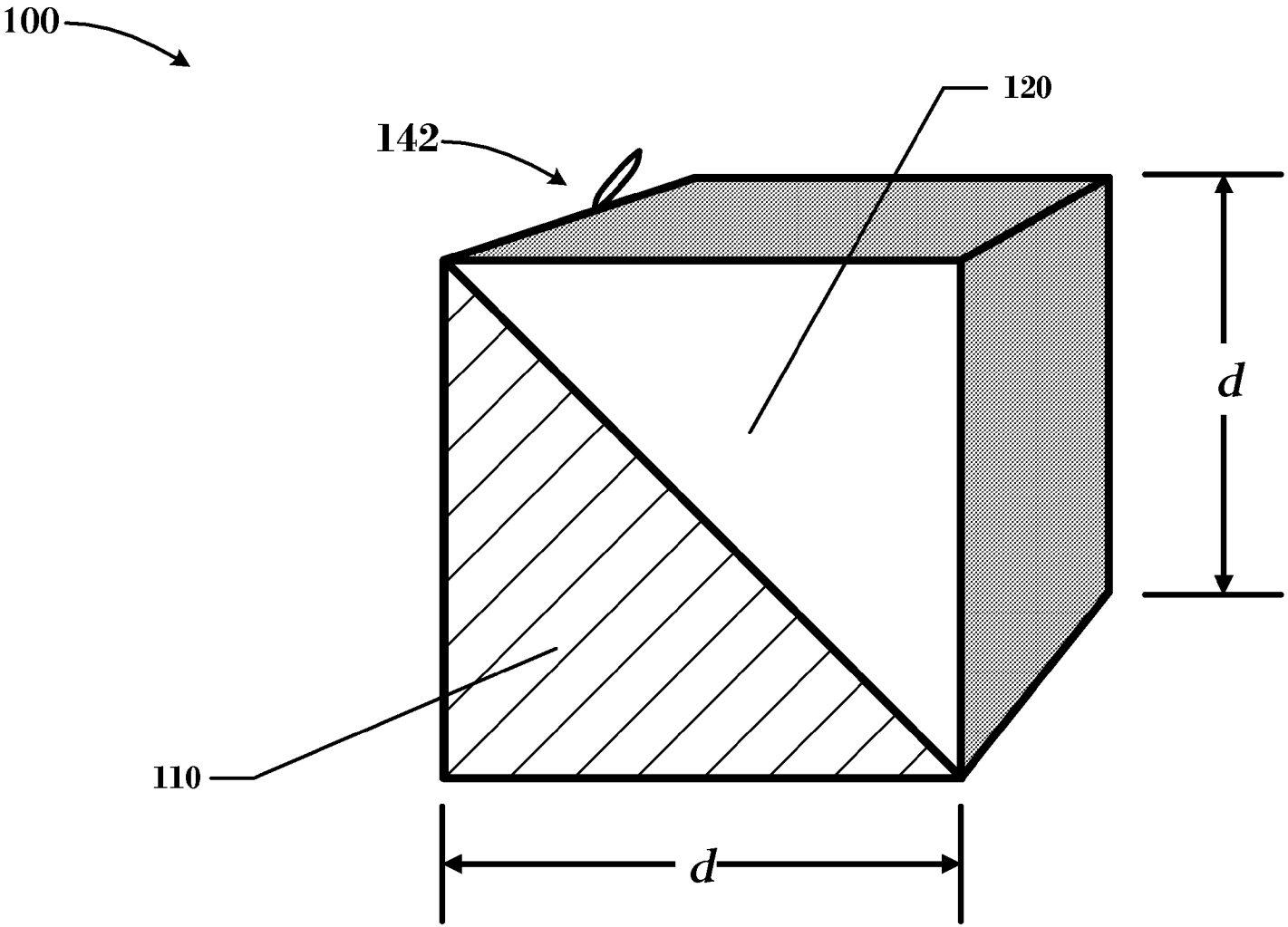
FIG. 1 is perspective view of a preferred embodiment of the improved support while in closed position.

Referring to FIG. 1, support 100 comprises two pillows 110, 120. Each pillow 110, 120 is a generally triangular prism having the same dimension d for each leg of its right isosceles triangular cross-section. Thus, when the two pillows are placed together as illustrated in FIG. 1, such that the hypotenuses of the triangles are immediately adjacent to each other, the support 100 as a whole forms a solid having a square cross-section; in the most preferred embodiment illustrated, the depth is also d and thus the solid is a cube of dimension d and having a volume of $d^3$. The two pillows are held together into the cube by a first, external closure mechanism generally indicated as 140 and including button 141 (not visible in FIG. 1) and loop 142; and a second, internal, closure mechanism generally indicated as 145 (not visible in FIG. 1), as discussed further below.

Figure 2:
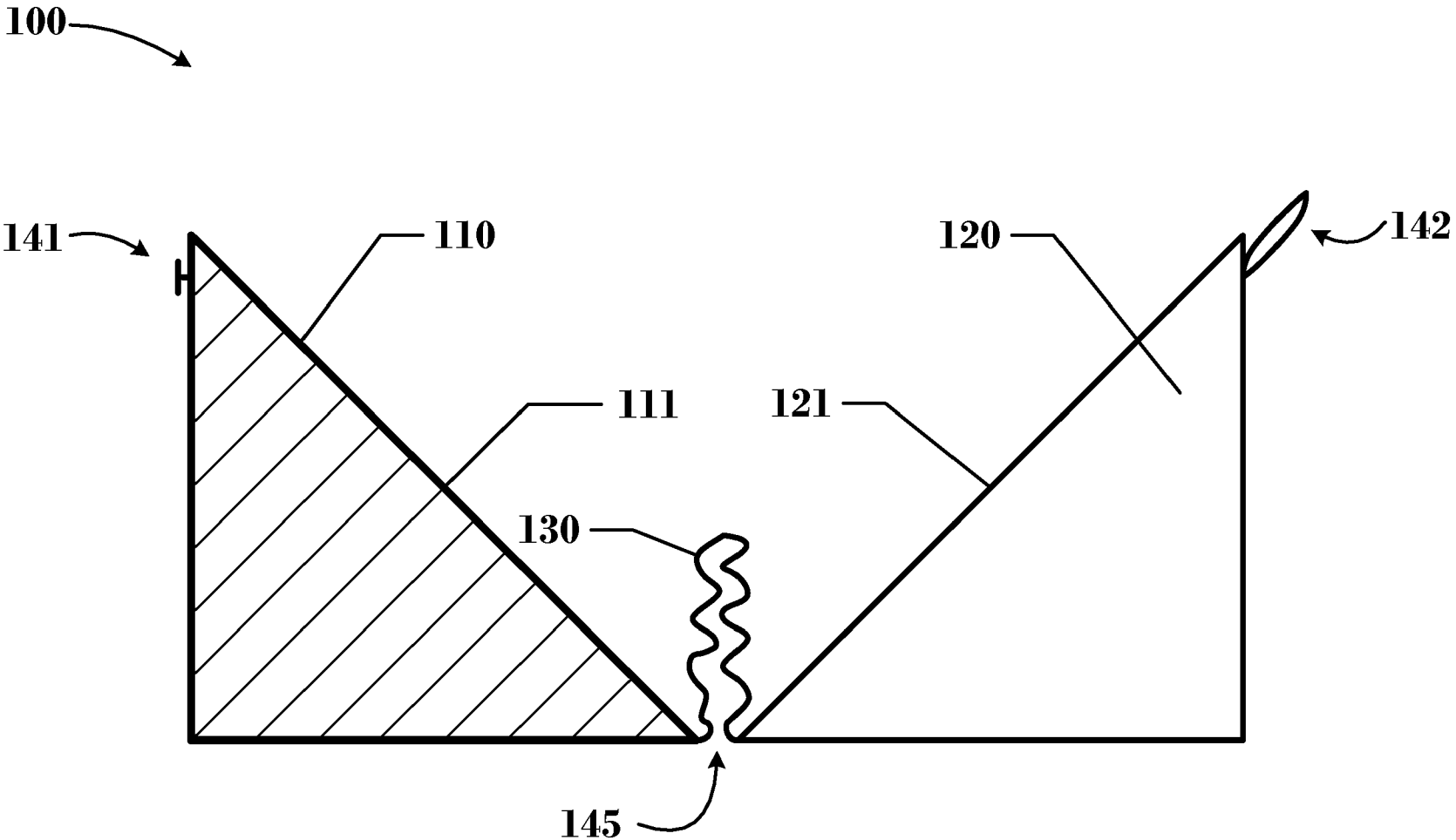
FIG. 2 is a front view of the preferred embodiment of FIG. 1 while in partially open position.
Figure 3:
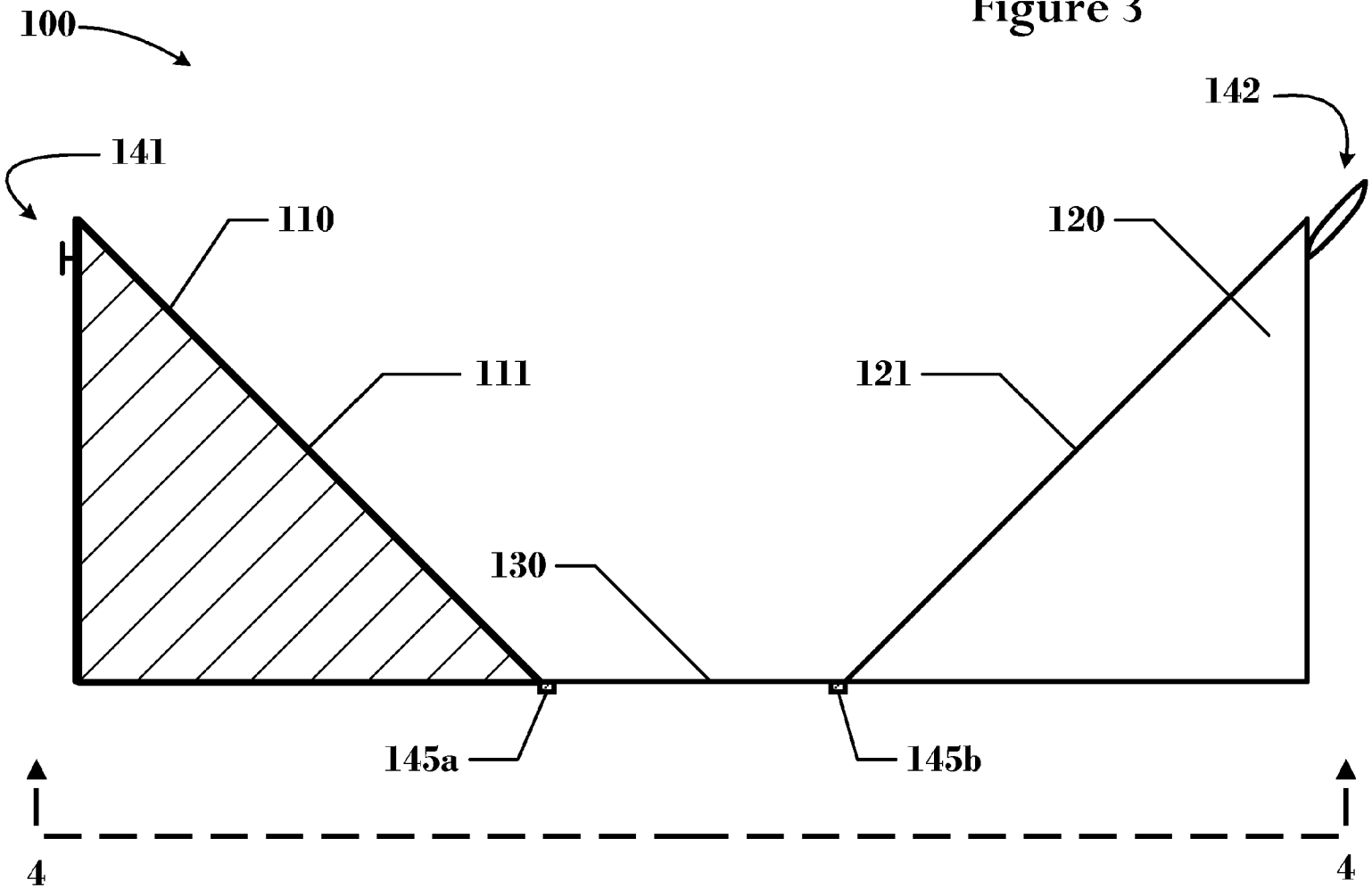
FIG. 3 is a front view of the preferred embodiment of FIG. 1 while in fully open position.
Figure 4:
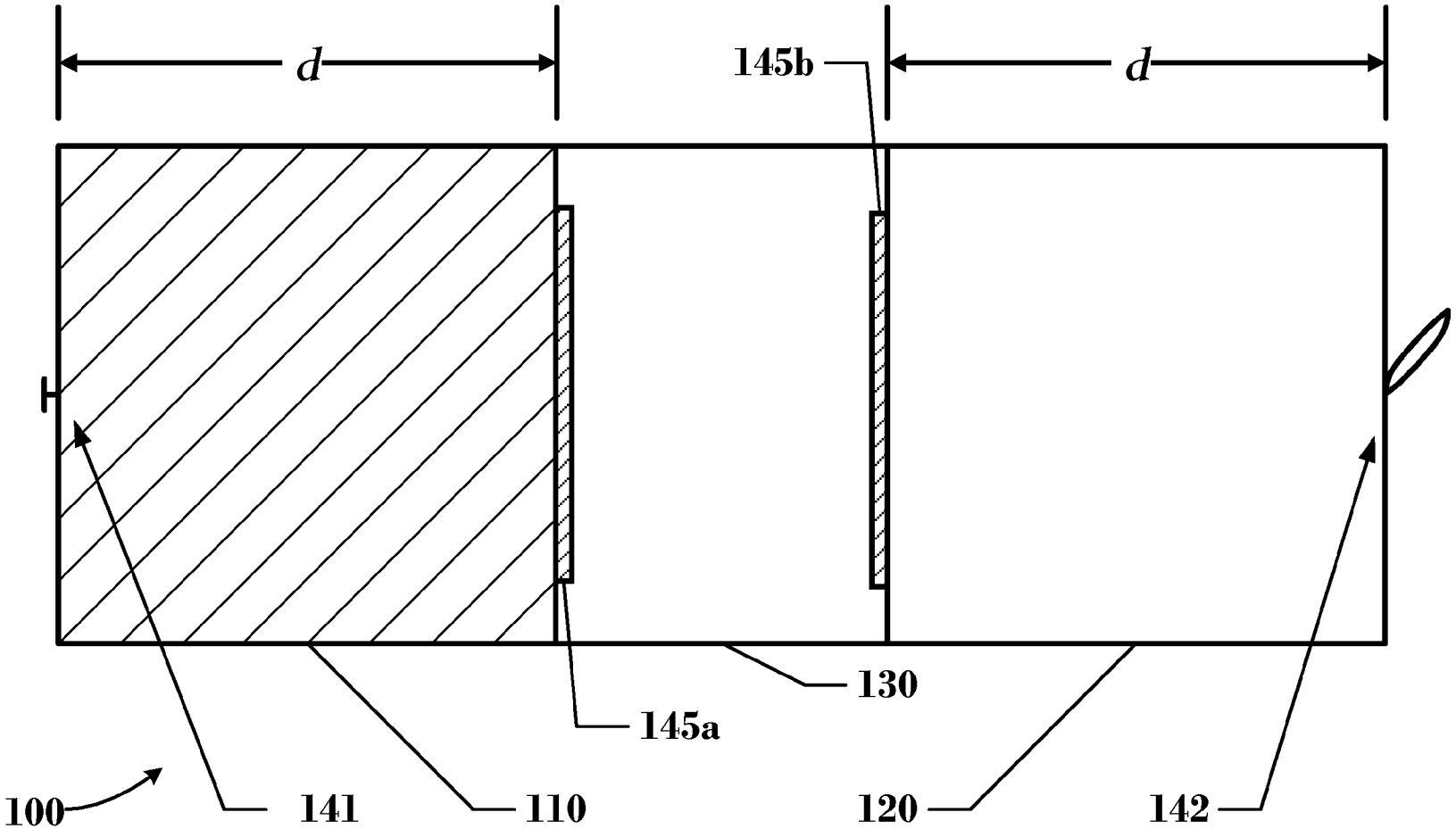
FIG. 4 is a bottom view of the preferred embodiment of FIG. 1 while in fully open position.

Referring to FIGS. 2-4, pillows 110, 120 are each connected at one edge to fabric 130. When support 110 is assembled as shown in FIG. 1, fabric 130 folds away into the space between the adjoining faces of pillows 110, 120. The external and internal closure mechanisms keep the two pillows together and the connecting fabric folded away. The length of fabric 130 is determined by the girth of the pregnant woman, i.e., it must be long enough to enable the woman to fit between pillows 110, 120, which has been determined to be a preferred value of approximately d. The width of fabric 130 (corresponding to the depth discussed above) is also preferred to be the same as the depth of each pillow 110, 120, or slightly less, so that when fabric 130 is centered in place and hidden within support 100 as shown in FIG. 1, the edges of fabric 130 are less likely to be visible from outside the fully assembled support.

Most women find that lying on their side is the most comfortable position, especially as the pregnancy progresses, because it keeps the baby's weight from putting too much pressure on the large vessels that carry blood to and from the heart, feet and legs. Some doctors specifically recommend that pregnant women sleep on their left side since this helps take pressure off the back and keeps the uterus off the liver, a rather large organ. Lying on the left side also optimizes blood flow to the placenta and, therefore, the baby.

Returning to FIGS. 2-4, to apply these concepts to support 100, the two pillows 110, 120 are capable of being separated and extended away from each other so that the connecting fabric 130 is unfolded and underneath the pregnant woman as she lies between the two flat plane surfaces 111, 121 that formerly contacted each other. Thus, when support 100 is fully extended as illustrated in FIG. 3, the pregnant woman lies on her side on fabric 130 between pillow 110 and pillow 120. For purposes of discussion, it may be assumed that when the woman is lying on her right side, the view in FIGS. 2 and 3 looks down at the top of her head (in medical terms, an inferior view). That is, pillow 110 is immediately adjacent her lower back and pillow 120 is immediately adjacent her stomach. Pillow 110 is therefore the firmer of the two pillows to support the woman's back, and pillow 120 is the more resilient of the two pillows to conform to the shape of her stomach. The material of one of the pillows may be a hypoallergenic memory foam, although other materials could be used provided the desired shape and cushioning properties are provided. A possible selection is hypoallergenic viscoelastic memory foam.

Each pillow should be covered with close-fitting fabric to provide a soft feel. Pregnant women are notoriously uncomfortable, particularly in the late term, and thus comfort is a very high concern. For this reason, exposed non-smooth seams in the fabric should be avoided (or located where they will not contact the woman in normal use).

The exterior cloth may also provide sufficient friction to help maintain the support in place and thus contribute to the support of the pregnant woman in a comfortable position. For example, it is possible but not required that the exterior cloth be textured in any convenient manner to keep the support from slipping out of position. Such texture may be due to the fabric itself, or it can be added in the form of "dots" or other shapes of an added material similar to that used for non-skid socks, gloves, and the like. The texture may be most appropriately present on certain of the sides of one or more pillows, but it is possible to provide texture on all the entire exterior of the support. However, given that the weight of the woman on the middle portion of the support will keep the two pillows in position, such textures are very likely to be unnecessary.

The exterior cloth may be made of one-hundred percent soft cotton, but it can be another soft fabric (either natural or artificial or a blend of the same). It is preferred but not required that the support be washable and reusable instead of disposable.

The patterns of the fabrics used on each of the two pillows may be the same, but it is preferred that they be different from each other to aid in distinguishing the pillows from each other. That is, a patterned fabric may indicate the firmer pillow for the back while a solid or otherwise distinguishable fabric is used to identify the resilient pillow for the front. In general, all that is required is that the appearance of one of the first and second pillows indicates that it provides substantially more support than the other.

As shown in the Figures, the shape of the pillow is generally that of a "wedge," or more properly a triangular prism. The exact dimension d of the pillow is not critical, and can be determined by the person of ordinary skill in the art by considering the dimensions that will produce a support suitable for the anatomies typically encountered in pregnant females.

Figure 5:
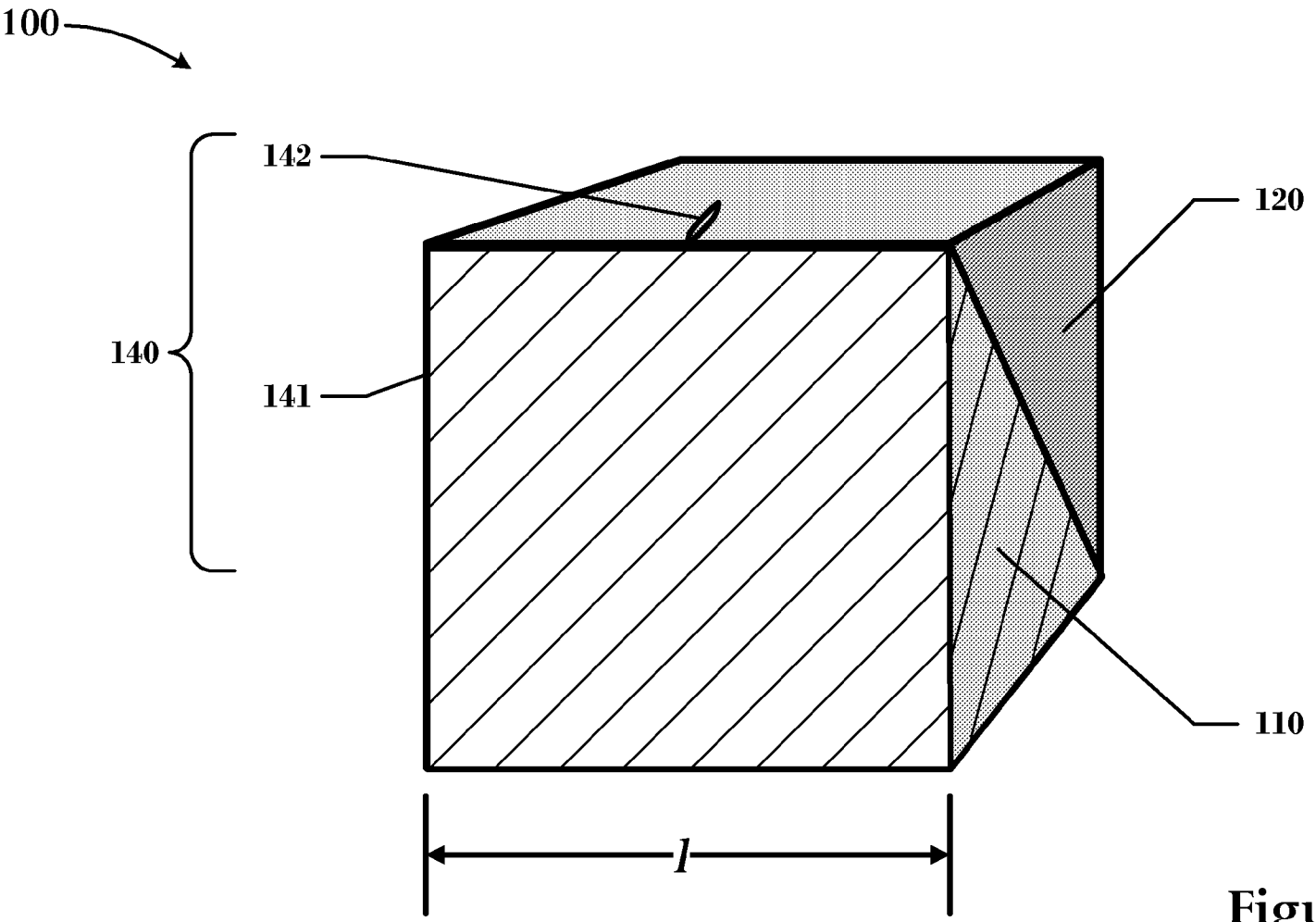
FIG. 5 is a left side view of the preferred embodiment of FIG. 1.

Preferred values for d include a seven inch size (small); an eight inch size (medium); and a nine inch size (large), each measurement being understood as the dimension d, the length of the side of the cube formed when the support is assembled as in FIGS. 1 and 5. In other embodiments, a set of four sizes of the invention (small/medium/large/extra-large) may provide greater selection and/or comfort.

Size may be selected by considering the woman's weight and/or girth, measured at the largest part of her stomach, i.e., the maximum circumference.

Unlike the approach illustrated in U.S. Pat. No. 2,562,725, embodiments described here include flat triangular or square planar faces, such as faces 111, 121, which enable support 100 to be assembled into a cube as illustrated in FIGS. 1 and 5. By contrast, the "wings" illustrated in that patent do not enable or suggest such an assembly. They are "convexly rounded" in two dimensions over their entire extent and thus the rounded opposing faces cannot be positioned flush against each other; also, the "wings" are wedge-shaped in the direction corresponding to the vertical height of the mother, as opposed to flat.

An additional difference is that the "central section" of the approach disclosed in that patent is stuffed with padded filler "such as featherdown, kapok, etc.," which gives it a thickness that prevents it from being folded into the middle of the assembled cube as described above.

The adjoining material 130 stretches only as much as necessary for the woman to fit between the pillows, thus ensuring that each pillow maintains contact with the woman. This enables the mother to comfortably maintain this position for long periods of time without repeated readjustment of the separation of the two pillows from each other.

As mentioned above, two separate closure mechanisms are preferred. The first closure mechanism 140 holds the two pillows 110, 120 together and may be (as in the embodiment illustrated) visible when the support 100 is assembled into a cube as illustrated in FIGS. 1 and 5. Thus, closure mechanism 140 is preferably decorative as well as functional. It may be buttons, bows, hook-and-pile ("VELCRO®") material, and the like. Referring specifically to FIG. 4, the preferred embodiment of closure mechanism 140 comprises a combination of a button 141 and a loop 142, each adjacent one of the exterior side faces of pillows 110, 120.

As illustrated in FIGS. 3 and 4, the second closure mechanism 145 is preferably a hook-and-pile ("VELCRO®") combination 145*a*, 145*b* that is placed on locations on the lowermost side of fabric 130 adjacent where the fabric 130 joins each pillow. This location places the combination 145*a*, 145*b* where they will face each other and, when pressed against each other, hold those locations of pillows 110, 120 together when the support as a whole is assembled together. A preferred arrangement is to have combination 145*a*, 145*b* run along most, but not all, of the entire depth of support 100. In the preferred embodiment, each of portions 145*a*, 145*b* ends approximately two inches away from each side of the outside edge of support 100.

For either the first closure mechanism 140 or the second closure mechanism 145, there may be a single instance of the respective closure mechanism as illustrated, or multiple instances. Any instance(s) of the closure mechanism(s) 140 or 145 may be positioned in a centered location as illustrated, or in any other location that proves to be effective.

Advantages

The embodiments disclosed in this application illustrate several improvements over the design of U.S. Pat. No. 2,562,725:

(1) Improved shapes to the two pillow sections to provide greater comfort, especially over long periods of time. The prior design employs pillows that are rounded in all directions and thus are more likely to impose their shape on the woman instead of the other way around. This actually decreases comfort, but the design illustrated here increases comfort.

(2) Improved selection of materials for the foam pillow sections, particularly in the use of incompressible foam as opposed to compliant foam material for one of the sections and compliant or "memory" foam for the other. This tailors the degree of support for the part of the woman's body that is being supported.

(3) Use of stretchable, flexible fabric to connect the two pillow sections together. This enables the support to adapt to the growth of the woman during pregnancy (particularly late term pregnancy).

(4) The ability to be by folded-up or assembled into a compact, attractive unit for storage. The flat faces of the design illustrated here provided this advantage, which cannot be achieved by the rounded faces of the prior design.

I claim:

1. A support for a pregnant woman having a back and a stomach and lying on her side, comprising:

a) first and second equally sized and shaped pillows, each of which is essentially shaped as a triangular prism having flat faces between its edges;

the first pillow comprising an incompressible foam material, covered with a first fabric that prevents the first material from being seen, the first fabric having a first visual pattern which identifies that the first pillow comprises the incompressible foam material; the second pillow comprising a foam material having substantially greater compressibility than the incompressible foam material of the first pillow, the second pillow being covered with a second fabric that prevents the second material from being seen, the second fabric having a second visual pattern different from the first visual pattern; and b) a stretchable piece of fabric joining each of the first and second pillows such that the support as a whole may be assembled to have a square cross-section when the flat faces of the first and second pillows are positioned flush against each other.

2. The support of claim 1, in which the support as a whole may be assembled into a cube shape.

3. The support of claim 1, further comprising at least one closure mechanism to hold the pillows together when the support as a whole is assembled.

4. A method of supporting a pregnant woman having a back and a stomach and lying on her side, comprising:

(a) providing first and second equally sized and shaped pillows, the first pillow comprising an incompressible foam material, and covering the first pillow with a first fabric to prevent the first material from being seen while providing the first fabric with a first visual pattern which identifies that the first pillow comprises the incompressible foam material; the second pillow comprising a foam material having substantially greater compressibility than the incompressible foam material of the first pillow, and covering the second pillow with a second fabric to prevent the second material from being seen while providing the second fabric with a second visual pattern different from the first visual pattern; and (b) providing a stretchable piece of fabric joining each of the first and second pillows.

5. The method of claim 4, in which each pillow is essentially shaped as a triangular prism having flat faces between its edges.

6. The method of claim 5, in which the support as a whole may be assembled to have a square cross-section.

7. The method of claim 6, in which the support as a whole may be assembled into a cube shape.

8. The method of claim 4, further comprising providing at least one closure mechanism to hold the pillows together when the support as a whole is assembled.

9. A method of manufacturing a support for a pregnant woman having a back and a stomach and lying on her side, comprising:

(a) providing first and second equally sized and generally triangular shaped pillows having flat faces between its edges, the first pillow comprising an incompressible foam material, covered with a first fabric that prevents the first material from being seen, the first fabric having a first visual pattern to identify that the first pillow comprises the incompressible foam material; and the second pillow comprising a foam material having substantially greater compressibility than the incompressible foam material of the first pillow, covered with a second fabric that prevents the first material from being seen, the second fabric having a second visual pattern different from the first visual pattern; and (b) providing a stretchable piece of fabric and attaching the fabric to an edge of each of the first and second pillows, such that the support as a whole may be assembled to have a square cross-section when the flat faces of the first and second pillows are positioned flush against each other.

10. The method of claim 9, in which the support as a whole may be assembled into a cube shape.

11. The method of claim 9, further comprising providing at least one closure mechanism to hold the pillows together when the support as a whole is assembled.

* * * * *